United States Patent [19]

Schmidt

[11] Patent Number: 4,973,422

[45] Date of Patent: Nov. 27, 1990

[54] PERFUME PARTICLES FOR USE IN CLEANING AND CONDITIONING COMPOSITIONS

[75] Inventor: Diane Grob Schmidt, Cincinnati, Ohio

[73] Assignee: The Procter & Gamble Company, Cincinnati, Ohio

[21] Appl. No.: 456,184

[22] Filed: Dec. 15, 1989

Related U.S. Application Data

[63] Continuation of Ser. No. 297,897, Jan. 17, 1989, abandoned.

[51] Int. Cl.[5] ..... C11D 3/37; C11D 3/50; C11D 11/00; D06M 13/45

[52] U.S. Cl. ..... 252/174.11; 252/8.8; 252/90; 252/173; 252/174.13; 252/174.18; 252/174.23; 252/174.24; 252/528; 252/547; 252/DIG. 2; 252/DIG. 3; 252/DIG. 13; 252/DIG. 14; 427/214; 512/4

[58] Field of Search ..... 252/174.11, 8.8, 90, 252/173, 174.13, 174.18, 174.23, 174.24, 528, 547, DIG. 2, DIG. 3, DIG. 13, DIG. 14; 427/214; 512/4

[56] References Cited

U.S. PATENT DOCUMENTS 4,906,488 4/1990 Pera ..... 252/315.1

*Primary Examiner*—Prince E. Willis
*Assistant Examiner*—Kevin McCarthy
*Attorney, Agent, or Firm*—Jerry J. Yetter; Gretchen R. Hatfield; Richard C. Witte

[57] ABSTRACT

Perfume particles are disclosed comprising perfume dispersed within certain water-insoluble polymeric carrier materials. Cleaning and conditioning compositions comprising these perfume particles are also disclosed. The perfume particles allow for preservation and protection of perfumes which are susceptible to degradation or loss in storage and in harsh cleaning conditions. The particles further allow for efficient delivery of a large variety of perfume types to fabrics or other surfaces.

4 Claims, No Drawings

PERFUME PARTICLES FOR USE IN CLEANING AND CONDITIONING COMPOSITIONS

This is a continuation of application Ser. No. 297,897, filed on Jan. 17, 1989.

TECHNICAL FIELD

Perfume particles are disclosed which comprise perfume dispersed within a water-insoluble low molecular weight polymeric carrier material. Cleaning and conditioning compositions having said particles incorporated therein are also disclosed.

BACKGROUND OF THE INVENTION

This invention is based on the concept of controlled perfume release, i.e., perfume release at a time and under conditions that will achieve the desired perfume effect. In general, this is a very old idea, and various methods for achieving this end have been developed, from the simple idea of putting perfume in wax candles to the complex technology of microencapsulation.

One aspect of the concept of controlled release of perfume is providing slow release of perfume over an extended period of time. This is generally achieved by blending perfume with a substance that will, in essence, "trap" the perfume so that small amounts of perfume are released over time. The use of high molecular weight polymeric substances having perfume incorporated therein to provide controlled release of perfume over time is known. See, for example, U.S. Pat. No. 4,184,099 Lindauer et al, issued Jan. 15, 1980; European Patent Application No.0 028 118, Leonard, published May 6, 1981; and U.S. Pat. No. 4,110,261, Newland, issued Aug. 29, 1978, which teach combining perfume with a release controlling medium and forming the combination into a solid product for air freshening.

Textile laundering, is also concerned with controlled release of perfumes. Application of this concept allows for slowing down or preventing release of perfume through long periods of shelf storage. Such a concept also allows for using much lower levels of perfume in product since much less perfume is wasted.

Perfume preservation over storage times can be achieved in a variety of ways. The perfume can be made a part of the package for the composition. The perfume can be combined with plastic used to make a bottle, or the perfume can be mixed with a polymer substance and the product used to coat a cardboard package composition, as is disclosed in U.S. Pat. No. 4,540,721, Staller, issued Sept. 10, 1985. Either way the perfume is released over time from the polymer matrix.

The perfume/controlled release agent may also be in the form of particles mixed into the laundry composition. One method taught to achieve this end is combining the perfume with a water-soluble polymer, forming into particles and adding to a laundry composition, as is described in U.S. Pat. No. 4,209,417, Whyte, issued June 24, 1980; U.S. Pat. No. 4,339,356, Whyte, issued July 13, 1982; and U.S. Pat. No. 3,576,760, Gould et al, issued Apr. 27, 1971.

The perfume may also be adsorbed onto a porous carrier material, which may be a polymeric material. See, for example, U.K. Patent Publication No. 2,066,839, Bares et al (applied for in the name of Vysoka Skola Chemicko Technologika), published July 15, 1981. These methods may also be used to mask unpleasant odors in a composition or to protect perfume from degradation by harsh components in a laundry composition. Such methods will provide these benefits only for dry powder or granular type compositions because, as soon as the polymer is hydrated the perfume is released. Thus, these methods provide for perfume fragrance benefits upon opening of the product package and loading into the washing apparatus. While these benefits are desirable, it would be even more desirable to have a method which allows for delivery of undiluted, undissipated and unaltered perfume to fabric and release of the perfume at the end of the laundry process so that the fabric is scented with the desirable perfume odor.

Of course, one method for achieving this end is putting the perfume into a product which goes directly into the dryer. This way, the perfume is delivered to the fabric in the dryer cycle. Such a method is taught in both U.S. Pat. No. 4,511,495, Melville, issued Apr. 16, 1985, and U.S. Pat. No. 4,636,330, Melville, issued Jan. 13, 1987. Both teach forming perfume into particles with a carrier. These particles are then formulated into a composition which is applied to textiles prior to putting into the dryer or prior to clothes-line drying.

An even more desirable method for delivering perfume to laundered fabric would be one which provides for protection of the perfume through the washing process and hence delivery of the perfume to fabric in essentially its original state.

Such a method must allow for prevention of dilution, degradation or loss of the perfume during the wash cycle of the laundry process. This is done by utilizing a system that releases the perfume in the drying process or later after the perfume has been delivered to the fabric. Preventing release of perfume during the washing process involves very different and more difficult technology. Such protection must be stable in not only the heat-elevated conditions of the wash but must also be stable against degradation by water and other harsh chemicals in the washing process such as bleach, enzymes, surfactants, etc.

One method which has been developed to provide these benefits is perfume microencapsulation. Here the perfume comprises a capsule core which is coated completely with a material which may be polymeric. U.S. Pat. No. 4,145,184, Brain et al, issued Mar. 20, 1979, and U.S. Pat. No. 4,234,627, Schilling, issued Nov. 18, 1980, teach using a tough coating material which essentially prohibits the diffusion out of the perfume. The perfume is delivered to fabric via the microcapsules and is then released by rupture of the microcapsules such as would occur with manipulation of the fabric. A problem with this method is that it takes a certain amount of effort to break the microcapsules.

A more desirable method would involve providing protection of perfume through the wash cycle and release of perfume in the heat-elevated conditions of the dryer. U.S. Pat. No. 4,096,072, Brock et al, issued June 20, 1978, teaches a method for delivering fabric conditioning agents to textiles through the wash and dry cycle via particles containing hydrogenated caster oil and a fatty quarternary ammonium salt. Perfume may be incorporated into these particles. However, it is not clear whether the perfume thus incorporated is released in the wash cycle or, more desirably, carried in the particles to the dryer and released there, as the particles soften.

U.S. Pat. No. 4,402,856, Schnoring et al, issued Sept. 6, 1983, teaches a microencapsulation technique which involves the formulation of a shell material which will allow for diffusion of perfume out of the capsule only at certain temperatures. This allows for maintenance of the perfume particles through storage and additionally through the wash cycle. The particles adhere to the fabric and are carried over to the dryer. Diffusion of the perfume out of the capsules then occurs only in heat-elevated conditions of the dryer. These particles are made of gelatin, an anionic polymer and a hardening agent.

U.S. Pat. No. 4,152,272, Young, issued May 1, 1979, teaches incorporating perfume into wax particles to protect the perfume through storage in dry compositions and through the laundry process. The perfume then diffuses through the wax matrix of the particles on the fabric in the heat-elevated conditions of the dryer.

It would be desirable to provide compositions comprising perfume particles that can be incorporated in liquid as well as dry granular or powder compositions and provide long-term storage stability.

It would be desirable to provide a method for delivering a broad range of perfume materials to fabric or other surfaces during the cleaning process.

It would be most desirable to have a perfumed cleaning or conditioning composition which would provide improved product odor, improved odor of perfume released during the cleaning process, and improved odor and intensity of perfume delivered to the surface being cleaned.

SUMMARY OF THE INVENTION

The present invention relates to perfume particles having an average size of less than about 350 microns which comprise from about 5% to about 70% of a perfume dispersed in from about 30% to about 95% of a water-insoluble polymeric carrier material having a molecular weight of from about 100 to about 30,000, a melting point of from about 37° C. to about 190° C., and a hardness value of from about 0.1 to about 15.0.

The present invention further relates to detergent compositions comprising from about 1% to about 90%, preferably from about 5% to about 50%, more preferably from about 10% to about 40%, of a surfactant selected from the group consisting of anionic, nonionic, zwitterionic, ampholytic, cationic surfactants and mixtures thereof, and an amount of the perfume particles as described above so that the detergent composition comprises from about 0.001 to about 10%, preferably from about 0.1% to about 3.0%, perfume.

The present invention further relates to conditioning compositions comprising from about 1% to about 90%, preferably from about 1% to about 50%, more preferably from about 3 to about 35%, of a conditioning agent selected from the group consisting of cationic softeners; and an amount of the perfume particles as described above so that the conditioning composition comprises from about 0.001% to about 10%, preferably from about 0.1% to 3.0%, perfume.

DETAILED DESCRIPTION OF THE INVENTION

The present invention allows for preservation, protection, and delivery of perfumes contained in cleaning and conditioning compositions through extended storage and harsh cleaning conditions. This is achieved by isolation of the perfume in a carrier material in the form of small particles. The individual components of the invention will now be discussed in detail.

THE PARTICLES

The perfume particles of the present invention comprise perfume dispersed in certain carrier materials.

In the context of this specification, the term "perfume" means any odoriferous material or any material which acts as a malodor counteractant. In general, such materials are characterized by a vapor pressure greater than atmospheric pressure at ambient temperatures. The perfume or deodorant materials employed herein will most often be liquid at ambient temperatures, but also can be solids such as the various camphoraceous perfumes known in the art. A wide variety of chemicals are known for perfumery uses, including materials such as aldehydes, ketones, esters and the like. More commonly, naturally occurring plant and animal oils and exudates comprising complex mixtures of various chemical components are known for use as perfumes, and such materials can be used herein. The perfumes herein can be relatively simple in their composition or can comprise highly sophisticated, complex mixtures of natural and synthetic chemical components, all chosen to provide any desired odor.

Typical perfumes herein can comprise, for example, woody/earthy bases containing exotic materials such as sandalwood oil, civet, patchouli oil and the like. The perfumes herein can be of a light, floral fragrance, e.g., rose extract, violet extract and the like. The perfumes herein can be formulated to provide desirable fruity odors, e.g., lime, lemon, orange and the like. Suitable perfumes include musk ambrette, musk ketone, musk tibetine, musk xylol, aurantiol, ethyl vanillin and mixtures thereof.

Perfume materials such as these are described more fully in S. Arctander, *Perfume Flavors and Chemicals. Vols. I and II*, Aurthor, Montclair, N.J., and the *Merck Index, 8th Edition*, Merck & Co., Inc. Rahway, N.J., both references being incorporated herein by reference.

In short, any chemically compatible material which exudes a pleasant or otherwise desirable odor can be used in the perfumed particles herein to provide a desirable odor when applied to fabrics.

Perfumes which are normally solid can also be employed in the present invention. These may be admixed with a liquefying agent such as a solvent prior to incorporation into the particles, or may be simply melted and incorporated, as long as the perfume would not sublime or decompose upon heating.

The invention also encompasses the use of materials which act as malodor counteractants. These materials, although termed "perfumes" hereinafter, may not themselves have a discernible odor but can conceal or reduce any unpleasant odors. Examples of suitable malodor counteractants are disclosed in U.S. Patent No. 3,102,101, issued Aug. 27, 1963, to Hawley et al.

The perfume particles of the present invention can comprise perfumes which are not typically used to deliver a fragrance to a surface, such as fabric through the laundry process. Perfume materials which are very volatile, unstable, or soluble in the particular compositions being used to deliver the perfume may be used in the present invention because the perfume is isolated from the composition in the particles. Perfume materials which are not substantive to fabrics in the laundry process can also be used in the present invention since the particles deliver the perfume to the fabric surface where it is released. Thus, use of the present invention to deliver a perfume to a surface, broadens the class of perfume materials that can be utilized.

Generally, the perfume particles of the present invention will comprise from about 5% to about 70%, preferably from about 5% to about 50%, perfume. The exact amount of perfume used in the particles will vary greatly depending on the strength of the particular fragrance used, and the desired odor effect.

The carrier materials of the perfumed particles must meet certain criteria to be useful in the present invention. First, the material must be a water-insoluble polymeric material. Further, the material must have a molecular weight between about 100 and about 30,000, preferably between about 500 and about 5000. Molecular weight of the material may be determined by any standard means. The material must also have a melting point of between about 37° C. and about 190° C. This will prevent melting of the particles in storage or the washing machine in laundry applications. (It is most desirable to have a carrier material that will not completely melt in an automatic dryer, to avoid blocking of the lint screen and excessive build-up of heat in the dryer). The melting point of the carrier material should also not be higher than a point at which the perfume to be combined therewith will decompose. The melting point of the carrier material is measured by what is called the drop melting point method. American Society for Testing and Materials (ASTM) Test Method D127-63 (reapproved 1982, incorporated by reference herein). Briefly, this method involves the following. The sample to be measured is deposited onto a thermometer bulb by dipping a chilled thermometer into the melted sample. The thermometer bearing the sample is then placed into a test tube and heated by means of a water bath until the sample melts and the first drop falls from the thermometer bulb. The average of the temperatures at which the drops of sample fall is the drop melting point of the sample.

The polymeric material must also be of a particular hardness. This hardness value may be measured by the standard test method for needle penetration of petroleum waxes. ASTM Test Method D1321-86 (incorporated by reference herein). Briefly, this method involves first melting and further heating the sample to be tested to 17° C. (30° F.) above its congealing point. The sample is then poured into a container and air cooled under controlled conditions. The sample is then conditioned at the test temperature in a water bath. Penetration is then measured with a penetrometer, which applies a standard needle to the sample for five seconds under a load of 100 grams. The penetration or hardness value is the depth, in tenths of a millimeter, to which the standard needle penetrates into the wax under these defined conditions. The hardness value of the carrier material must be between about 0.1 and about 15, preferably between 0.1 and 8, to be useful in the present invention. This will allow for particles of a hardness that will optimize the perfume protection/preservation in the carrier.

The carrier material must also be inert to the perfume and relatively odorless. The material must allow for diffusion of the perfume therethrough. The carrier material must also be such that it melts without decomposition.

Nonlimiting examples of useful carrier materials include polyethylenes, polyamides, polystyrenes, polyisoprenes, polycarbonates, polyesters, polyacrylates, vinyl polymers and polyurethanes and mixtures thereof, which meet the above-described criteria, e.g., they are water-insoluble, have a molecular weight between about 100 and about 30,000, have a melting point between about 37° C. and 190° C. and a hardness value between 0.1 and 15.

One carrier material which meets all of these specified criteria is sold under the trade name POLYWAX 2000 by Petrolite Specialty Polymers Group. This material is a polyethylene having a molecular weight of about 2,000, a melting point of about 259° F. (126° C.), and a hardness value (as measured above) at 77° F. (25° C.) of about 0.5. Another material which meets these criteria is POLYWAX 1000 (also sold by Petrolite Specialty Polymers Group). This material is also a polyethylene having a molecular weight of about 1,000, a melting point of about 237° F. (114° C.), and has a hardness value at 77° F. (25° C.) of about 1.0.

It may be desirable to utilize a mixture of different carrier materials in the perfume particles of the present invention, for example, a blend of a polymeric material and a minor amount of a wax material. Examples of useful wax materials include the materials sold under the trade names BOLER 1014, STARWAX 100, and VICTORY, all available from the Boler Petroleum Company. Such a blend might allow for better deposition properties because the particles formed therefrom would have a "stickier" surface. A great number of combinations of materials are possible and are intended to be covered by this invention so long as the final blend of carrier materials meets the criteria outlined above.

The choice of carrier material to be used in the perfume particles of the present invention will depend to some degree on the particular perfume to be used. Some perfumes will require a greater amount of protection than others and the carrier material to be used therewith can be chosen accordingly.

Generally, the perfume particles of the present invention will comprise from about 30% to about 95%, preferably from about 50% to about 95% carrier material. Again, this will vary with the type and amount of the particular perfume being utilized.

The perfume-containing particles are made as follows. The carrier material is first heated slowly to its melting point. The material is not heated any more than is necessary to just melt the substance. The perfume is then quickly added, generally as an oil or liquid, at room temperature to the melted carrier substance. The two are quickly mixed into a homogeneous blend then rapidly cooled with liquid nitrogen (or with dry ice or any other means which will cool the mixture quickly) until it has completely solidified. The solid material is then subdivided, generally by grinding or milling, to produce particles of the desired average size. Other methods such as spray cooling or extrusion may also be used to subdivide the particles.

The perfume particles should be made to have a particle size less than 350 microns. Particle sizes larger than this may be more rapidly lost from the surface they are deposited to and do not provide a relative great enough surface area to release the perfume at the desired rate. Also, particles larger than this may be noticeable on the surface being treated. Particles at the low end of this range, i.e. less than about 100 microns, tend to adhere well to the surface they are delivered to but release the perfume much more readily than larger particles so that the perfume may be dissipated during storage. Additional protection of particles of this size may be necessary to make them useful in the present invention. For example, these smaller particles may comprise polymeric carrier materials which are specially selected to provide additional perfume protection. Additionally, if the particles are incorporated into a liquid composition which has a relatively high viscosity the perfume will not diffuse out of the particles as readily. Finally, the particles may be coated with a material that will slow the rate of diffusion of perfume therethrough.

If the particles to be utilized are not protected via any of these means, preferably the average particle size is larger than 100 microns. Larger particle sizes are more desirably used in compositions such as dry granular detergent compositions, where the larger particle size may help to prevent-segregation of the perfume particles from the detergent granules.

The amount of perfume particles used in the compositions of the present invention will depend on the amount of perfume that is desired to be delivered to a particular surface. For example, for laundry detergent and conditioning compositions, generally from about 0.001% to about 10%, preferably from about 0.1% to about 3%, perfume in the product composition is desirable.

To further stabilize particularly volatile perfumes, it may be desirable to preload the perfume (i.e., mix the perfume) onto silica gel or clay prior to combining with the carrier substance. Some perfumes which are not so volatile will not require this special treatment because it would inhibit their release from the carrier substance too much. Optimization of the rate at which the perfume is released from the carrier is the goal, and this additional step allows for better control of that rate with some of the more volatile perfumes.

To further protect the perfume-containing particles in storage, it may be desirable to coat the perfume particles with a material which will prevent the perfume from diffusing out of the particles as readily during long storage periods. This procedure is especially useful when the more volatile perfumes are used, or when particles of a size less than 100 microns are used.

The coating material must be a good film-forming material and it must be inert to the ultimate product composition as well as the perfumed carrier material.

The particles may be coated with more than one coating material to produce a particle having more than one layer of coating material. Different coating materials can be chosen to provide different perfume protection as needed.

The individual perfume-containing particles may also be agglomerated with the coating material to provide larger particles which comprise a number of the individual perfume-containing particles. This agglomerating material surrounding the particles provides an additional barrier to diffusion of the perfume out of the particles. Such an approach also minimizes the surface area of free particles susceptible to perfume diffusion. The ratio of perfume particles to agglomerate material will vary greatly depending upon the extent of additional protection desired. This agglomeration approach may be particularly useful with very volatile perfumes or perfumes that are especially susceptible to degradation. Also, agglomeration of very small perfume particles would provide additional protection against premature diffusion out of perfume.

An alternative approach would involve first coating the individual perfume particles with one coating material and then agglomerating the coated particles with another material. Selection of different coating materials will affect the protection afforded the particles.

Agglomeration of particles in this fashion may also be useful in preventing segregation of small perfume particles from larger detergent granules in a dry granular detergent product.

A wide variety of possibilities exist which will allow for delivery of perfume effect at various times in the cleaning or conditioning process. The less protection provided results in greater perfume effect in product or washing/conditioning process. More protection results in greater perfume effect during the drying process or even later, after the surface has been treated.

Greater protection can be provided by choice of carrier material to be used to form the particles, ratio of perfume to carrier material in the particles, choice of coating material or coating materials (laminate), or agglomeration of particles.

The coating process may be done, for example, with a Wurster fluid bed coater by first making an aqueous solution of the coating material and then contacting the solution with the particles in the fluid bed coater.

Addition of a plasticizer substance to the coating material prior to the coating process will further enhance protection of the perfume-containing particles. The plasticizer will prevent formation of cracks in the coating material over time and helps to prevent the coating material from becoming too brittle.

If the perfume particles are to be incorporated into a dry granular or powder product, the coating material may be water soluble. Such a coating material will protect the perfume particles during storage in product and then may be stripped away when brought into contact with water.

Nonlimiting examples of suitable water-soluble coating materials include such substances as methyl cellulose, maltodextrin, and gelatin.

Nonlimiting examples of plasticizer materials suitable for use with these water-soluble coating materials include glycerin, polyethylene glycol, polypropylene glycol and mixtures thereof; triacetin; triacetin citrate; and lower molecular weight maltodextrins (DE=5); the latter for use with maltodextrin. Generally, the plasticizer material will comprise about 0.5%-10%, by weight of the particles.

For enhanced protection of the perfume particles in a liquid product, it is more desirable to coat the particles with a material that is pH sensitive, i.e., a material that will remain as a coating on the particle in one pH environment but which would be removed from the particle in a different pH environment. For example, such a coating material could be used to coat perfume particles in a liquid fabric softening composition having a pH of about 3. When such a composition is added to the laundry wash water where the pH is greater than 6, the coating material could be stripped away. This would allow for further protection of perfume in liquid compositions over long storage periods, i.e., the perfume would not diffuse out of the particle in the liquid medium as readily. Diffusion of the perfume out of the stripped particle would then take place after the particles were brought into contact with a different pH environment.

Nonlimiting examples of suitable pH-sensitive coating materials include acrylic resins, such as those sold under the trade name EUDRAGIT available from Rohm Pharma, materials sold under the trade name AQUATERIC, available from FMC Corp., and cellulose acetate phthalate and trimellitiate, available from Eastman Kodak.

Generally, such pH-sensitive coating materials will comprise from about 5% to about 50%, by weight, of the particles.

Nonlimiting examples of plasticizer materials suitable for use with these pH-sensitive coating materials include diethyl phthalate, tributyl citrate, acetyltributyl citrate, and combinations of propylene glycol or polyethylene glycol with diethyl phthalate (1:1 ratio).

The perfume particles may also be coated with a material that makes the particles more substantive to the surface being treated for example, fabric in the laundry process. Such materials help to deliver the particles to the fabric and maximize perfume release directly on the fabric. Generally, these materials are water-insoluble cationic materials. Examples of useful material include any of the cationic (including imidazolinium) compounds listed in U.S. Pat. No. 3,686,025, Morton, issued Aug. 22, 1972, incorporated herein by reference. Such materials are well known in the art and include, for example, the quaternary ammonium salts having at least one, preferably two, $C_{10}$–$C_{20}$ fatty alkyl substituent groups; alkyl imidazolinium salts wherein at least one alkyl group contains a $C_8$–$C_{25}$ carbon "chain"; the $C_{12}$–$C_{20}$ alkyl pyridinium salts, and the like.

Preferred cationic softeners useful herein to aid in deposition on fabric include quaternary ammonium salts of the general formula $R^1R^2R^3R^4N^+,X^-$, wherein groups $R^1R^2R^3$ and $R^4$ are, for example, alkyl, and $X^-$ is an anion, e.g., halide, methylsulfate, and the like, with the chloride and methylsulfate salts being preferred. Especially preferred materials are those wherein $R^1$ and $R^2$ are each $C_{12}$–$C_{20}$ fatty alkyl and $R^3$ and $R^4$ are each $C_1$–$C_4$ alkyl. The fatty alkyl groups can be mixed, i.e., the mxed $C_{14}$–$C_{18}$ tallowalkyl quaternary compounds. Alkyl groups $R^3$ and $R^4$ are preferably methyl.

Exemplary quaternary ammonium softeners useful herein include ditallowalkyldimethylammonium methylsulfate, ditallowalkyldimethylammonium chloride, dicoconutalkyldimethylammonium methylsulfate, and dicoconutalkyldimethylammonium chloride.

Generally, these coating materials will comprise from about 1% to about 25% of the perfume particles.

Alternative materials useful for coating the present perfume particles to make them more fabric substantive are described in U.S. Pat. No. 4,234,627, Schilling, issued Nov. 18, 1980, herein incorporated by reference.

Still other coating materials that may be useful for this purpose include silicones and amines.

These types of coating materials may be used alone or in combination with the water-soluble or pH-sensitive coating materials described above to provide a laminated coating.

The perfume particles of the present invention can be incorporated into a wide variety of compositions which deliver a perfume to a surface. One particularly appropriate application is in laundry products. Perfume delivery to fabric through the laundry process is not a simple task. The present invention solves many of the problems generally associated with perfume delivery in this context, e.g., storage stability of perfume in product over extended periods of time or due to incompatibility of perfume with conventional laundry composition components, such as bleach, enzymes, etc. and dilution or degradation of perfume in the wash process.

CLEANING COMPOSITIONS

The perfumed particles of the present invention may be incorporated in granular or liquid laundry detergent compositions of conventional type. These can contain from about 1% to about 90%, preferably from about 5% to about 50%, more preferably from about 10% to about 40% by weight of organic surfactant selected from anionic, nonionic, zwitterionic, ampholytic, cationic surfactants and mixtures thereof. A typical listing of the classes and species of these surfactants is given in U.S. Pat. No. 3,663,961, issued to Norris on May 23, 1972, and incorporated herein by reference.

Suitable synthetic anionic surfactants are water-soluble salts of alkyl benzene sulfonates, alkyl sulfates, methyl ester sulfonates, alkyl polyethoxy ether sulfates, paraffin sulfonates, alpha-olefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxy-alkane-1-sulfonate, beta-alkyloxy alkane sulfonate, and soaps.

A particularly suitable class of anionic detergents includes water-soluble salts, particularly the alkali metal, ammonium and alkanolammonium salts or organic sulfuric reaction products having in their molecular structure an alkyl or alkaryl group containing from about 8 to about 22, especially from about 10 to about 20, carbon atoms and a sulfonic acid or sulfuric acid ester group. (Included in the term "alkyl" is the alkyl portion of acyl groups.) Examples of this group of synthetic detergents which may form part of the detergent compositions of the present invention are the sodium and potassium alkyl sulfates, especially those obtained by sulfating the higher alcohols ($C_8$–$C_{18}$) carbon atoms produced by reducing the glycerides of tallow or coconut oil and sodium and potassium alkyl benzene sulfonates, in which the alkyl group contains from about 9 to about 15, especially about 11 to about 13, carbon atoms, in straight chain or branched chain configuration, e.g., those of the type described in U.S. Pat. No. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulfonates in which the average of the alkyl group is about 11.8 carbon atoms, abbreviated as $C_{11.8}$LAS.

Other anionic detergent compounds herein include the sodium $C_{10}$–$C_{18}$ alkyl glyceryl ether sulfones, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts of esters of $\alpha$-sulfonated fatty acids containing from about 6 to 20 carbon atoms in the fatty acid group and from about I to 10 carbon atoms in the ester group; water-soluble salts of 2-acyloxyalkane-1 sulfonic acids containing from about 2 to 9 carbon atoms in the acyl group and from about 9 to about 23 carbon atoms in the alkane moiety; alkyl ether sulfates containing from about 10 to 18, especially about 12 to 16, carbon atoms in the alkyl group and from about 1 to 12, especially 1 to 6, more especially 1 to 4 moles of ethylene oxide; water-soluble salts of olefin sulfonates containing from about 12 to 24, preferably about 14 to 16, carbon atoms, especially those made by reaction with sulfur trioxide followed by neutralization under conditions such that any sultones present are hydrolysed to the corresponding hydroxy alkane sulfonates; water-soluble salts of paraffin sulfonates containing from about 8 to 24, especially 14 to 18 carbon atoms, and β-alkyloxy alkane sulfonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow or can be made synthetically as, for example, using the Ziegler or Oxo processes. Water solubility can be achieved by using alkali metal, ammonium or alkanolammonium cations; sodium is preferred. Magnesium and calcium are preferred cations under circumstances described by Belgian Patent No. 843,636, Jones et al, issued Dec. 30, 1976. Mixtures of anionic surfactants are contemplated by this invention; a preferred mixture contains alkyl benzene sulfonate having 11 to 13 carbon atoms in the alkyl group or paraffin sulfonate having 14 to 18 carbon atoms and either an alkyl sulfate having 8 to 18, preferably 12 to 18, carbon atoms in the alkyl group, or an alkyl polyethoxy alcohol sulfate having 10 to 16 carbon atoms in the alkyl group and an average degree of ethoxylation of 1 to 6.

Ethoxylated nonionic surfactants materials can be broadly defined as compounds produced by the condensation of ethylene oxide groups (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements. In general, ethoxylated nonionic surfactants suitable herein have an average ethyleneoxy content in the range from about 35% to about 70%, by weight of the surfactant.

Examples of suitable nonionic surfactants include the condensation products of primary or secondary aliphatic alcohols having from 8 to 24 carbon atoms in either straight chain or branched chain configuration with from 2 to about 18 moles of alkylene oxide per mole of alcohol. Preferably, the aliphatic alcohol comprises between 9 and 15 carbon atoms and is ethoxylated with between 2 and 9, desirably between 3 and 8, moles of ethylene oxide per mole of aliphatic alcohol. Such nonionic surfactants are preferred from the point of view of providing good to excellent detergency performance on fatty and greasy soils and in the presence of hardness sensitive anionic surfactants such as alkyl benzene sulfonates. The preferred surfactants are prepared from primary alcohols having no more than about 50% chain branching, i.e., which are either linear (such as those derived from natural fats or prepared by the Ziegler process for ethylene, e.g., myristyl, cetyl, stearyl alcohols) or partly branched such as the Dobanols and Neodols, which have about 25% 2-methyl branching (Dobanol and Neodol being trade names of Shell) or Synperonics, which are understood to have about 40% to 50% 2-methyl branching. (Synperonic is a trade name of I.C.I.) Specific examples of nonionic surfactants falling within the scope of the invention include Dobanol 45-4, Dobanol 45-7, Dobanol 45-9, Dobanol 91-3, Dobanol 91-6, Dobanol 91-8, Synperonic 6, Synperonic 9, the condensation products of coconut alcohol with an average of between 5 and 9 moles of ethylene oxide per mole of alcohol, the coconut alkyl portion having from 10 to 14 carbon atoms and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, for example, those ethoxylates of the Tergitol series having from about 9 to 15 carbon atoms in the alkyl group and up to about 11, especially from about 3 to 9, ethoxy residues per molecule.

Of the above, highly preferred are alkoxylated nonionic surfactants having an average HLB in the range from about 9.5 to 13.5, especially 10 to 12.5. Highly suitable nonionic surfactants of this type are ethoxylated primary $C_{9-15}$ alcohols having an average degree of ethoxylation from about 2 to 9, more preferably from about 3 to 8.

Other useful nonionic surfactants include carbohydrate based surfactants and amine oxides based on olefins.

Suitable ampholytic surfactants are water-soluble derivatives of aliphatic secondary and tertiary amines in which the aliphatic moiety can be straight chain or branched and wherein one of the aliphatic substituents contains from about 8 to 18 carbon atoms and one contains an anionic water-solubilizing group, e.g., carboxy, sulfonate, sulfate, phosphate or phosphonate.

Suitable zwitterionic surfactants are water-soluble derivatives of aliphatic quaternary ammonium phosphonium and sulfonium cationic compounds in which the aliphatic moieties can be straight chain or branched, and wherein one of the aliphatic substituents contains from about 8 to 18 carbon atoms and one contains an anionic water-solubilizing group.

Cationic surfactants that may be used in the detergent compositions of the present invention include coconut trimethylammonium chloride.

The detergent compositions of the invention can also contain from about 1% to about 80%, preferably from about 5% to about 50%, of detergency builder.

Suitable detergent builder salts useful herein can be of the polyvalent inorganic and polyvalent organic types or mixtures thereof. Non-limiting examples of suitable water-soluble inorganic alkaline detergent builder salts include the alkali metal carbonates, borates, phosphates, polyphosphates, tripolyphosphates and bicarbonate.

Examples of suitable organic alkaline detergency builder salts are:

(1) Water-soluble amino polyacetates, e.g., sodium and potassium ethylendiaminetetraacetates, nitrilotriacetates and N-(2-hydroxyethyl)nitrilodiacetates;

(2) Water-soluble salts of phytic acid, e.g., sodium and potassium phytates;

(3) Water-soluble polyphosphonates, including sodium, potassium and lithium salts of ethane-1-hydroxy-1,1-diphosphonic acid; sodium, potassium and lithium salts of methylenediphosphonic acid and the like.

(4) Water-soluble polycarboxylates such as the salts of lactic acid, glycollic acid and ether derivatives thereof as disclosed in Belgian Patent Nos. 821,368, 821,369 and 821,370; the materials disclosed in U.S. Pat. No. 4,663,071, Bush et al, issued May 5, 1987; succinic acid, malonic acid, (ethylenedioxy) diacetic acid, maleic acid, diglycollic acid, tartaric acid, tartronic acid and fumaric acid; citric acid, aconitic acid, citraconic acid, carboxymethyloxysuccinic acid, lactoxysuccinic acid and 2-oxy-1,1,3-propane-tricarboxylic acid; oxydisuccinic acid, 1,1,2,2-ethane tetracarboxylic acid, 1,1,3,3-propane tetracarboxylic acid and 1,1,2,3-propane tetracarboxylic acid; cyclopentane-cis, cis, cis-tetracarboxylic acid, cyclopentadienide penta-carboxylic acid, 2,3,4,5-tetrahydrofuran-cis, cis, cis-tetracarboxylic acid, 2,5-tetrahydrofuran-cis-dicarboxylic acid, 1,2,3,4,5,6-hexane-hexacarboxylic acid, mellitic acid, pyromellitic acid and the phthalic acid derivatives disclosed in British Patent No. 1,425,343.

Mixtures of organic and/or inorganic builders can be used herein. One such mixture of builders is disclosed in Canadian Patent No. 755,038, e.g., a ternary mixture of sodium tripolyphosphate, trisodium nitrilotriacetate and trisodium ethane-1-hydroxy-1,1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of British Patent Specification No. 1,429,143, published Mar. 24, 1976, German Patent Application No. OLS 2,433,485, published Feb. 6, 1975, OLS 2,525,778, published Jan. 2, 1976, and U.S. Pat. No. 4,605,509, Corkill et al, issued Aug. 12, 1986, the disclosures of which are incorporated herein by reference.

Another suitable component of the present compositions is a water-soluble magnesium salt which is added at levels in the range from about 0.015% to about 0.2%, preferably from about 0.03% to about 0.15%, and more preferably from about 0.05% to about 0.12%, by weight of the compositions (based on weight of magnesium). Suitable magnesium salts include magnesium sulfate, magnesium sulfate heptahydrate, magnesium chloride, magnesium chloride hexahydrate, magnesium fluoride and magnesium acetate. Desirably, the magnesium salt is added to the compositions as part of the aqueous slurry crutcher mix and is then converted to dry granular form, for instance by spray drying. The magnesium salt can provide additional low temperature stain removal benefits as described in British Patent Application No. 80/15542.

The detergent compositions of the invention can also be supplemented by bleaches, especially sodium perborate tetrahydrate or sodium percarbonate at levels from about 5% to about 50%. Examples of laundry compositions containing bleaching agents which are useful in the present invention are those disclosed in U.S. Pat. No. 4,412,934, Chung et al, issued Nov. 1, 1983; U.S. Pat. No. 4,536,314, Hardy et al, issued Aug. 20, 1985; U.S. Pat. No. 4,539,130, Thompson et al, issued Sept. 3, 1985; and U.S. Pat. No. 4,681,695, Divo, issued July 21, 1987. The perfumed particles of the present composition are particularly useful in such compositions because the perfume is protected from degradation by the bleach.

The compositions of the present invention may also include from about 0.05% to about 0.6% (acid basis), preferably from about 0.06% to about 0.3%, of aminopolyphosphonic acid, or salt thereof, having the general formula:

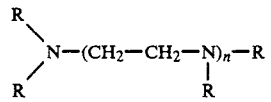

wherein n is an integral number from 0 to 3, and each R is individually hydrogen or $CH_2PO_3H_2$ provided that at least half of the radicals represented by R are $CH_2PO_3H_2$. Preferred aminopolyphosphonic acids are selected from nitrilotri(methylenephosphonic acid), ethylene-diaminetetra(methylenephosphonic acid), diethylenetriamine(pentamethylenephosphonic acid) and mixtures thereof.

An alkali metal, or alkaline earth metal, silicate can also be present in the compositions of the present invention. The alkali metal silicate is preferably present at from about 3% to about 8%. Suitable silicate solids have a molar ratio of $SiO_2$/(alkali metal)$_2$O in the range from about 1.0 to about 3.3, more preferably from 1.5 to 2.0. Other suitable ingredients include soil-suspending agents such as the water-soluble salts of carboxymethyl cellulose and of methyl vinylether/maleic anhydride copolymer, nonionic cellulose materials such as hydroxyethyl cellulose and polyethylene glycols. Examples of soil release polymer materials suitable for use in the detergent compositions of the present invention are disclosed in U.S. Pat. No. 4,702,857, Gosselink, issued Oct. 27, 1987.

Preferred enzymatic materials for use in the present invention include the commercially available amylases and neutral and alkaline proteases conventionally incorporated into detergent compositions. Suitable enzymes are discussed in U.S. Pat. Nos. 3,519,750, 3,533,139, and 4,767,557. Examples of suitable enzymes include lipase, cellulase and the materials sold under the Registered Trade Marks Maxatase and Alcalase.

Examples of bleach activators suitable in the compositions of the invention are organic peroxyacid precursors including esters such as trichloroethyl acetate, acetylacetohydroxamic acid, sodium p-acetoxy benzene sulphonate sodium benzoyl phenol sulphonate, methyl o-acetoxy benzoate and Bisphenol A diacetate; imides such as N-acetyl caprolactam, N-benzene sulphonyl phthalimide, tetraacetylethylenediamine, tetraacetylmethylenediamine, tetraacetylhexamethylenediamine and tetraacetylglycouril; imidazoles such as N-acetylbenzimidazole; oximes such as diacetyl dimethyl glycoxime; as well as certain carbonates, guanidines, triazine derivatives; and nonanoyl sodium acyl-oxybenzene sulfonate (also in the bisform).

The detergent compositions of the present invention may also comprise fabric softening agents. Examples of such materials include smectite type clays such as bentonite, polyethylene oxide with a molecular weight of about 500,000,000, and N,N-ditallowmethyl amine. Examples of such laundry cleaning and conditioning compositions are disclosed in U.S. Pat. Nos. 4,141,841, McDonald, issued Feb. 27, 1979, and U.S. Pat. No. 4,762,645, Tucker et al, issued Aug. 9, 1988.

Other optional detergent composition components include halogen bleaches (e.g., sodium and potassium dichloroisocyanurates), soil suspending agents (e.g., sodium carboxymethylcellulose), fabric brighteners, enzyme stabilizing agents, color speckles, suds boosters or suds suppressors, anticorrosion agents, dyes, fillers, germicides, pH adjusting agents, nonbuilder alkalinity sources, and the like.

To combine the perfumed particles with a granular detergent composition, it is most desirable to coat the particles or agglomerate the particles with a water-soluble inert filler material to achieve particles of the same size as the granules. This will allow for a homogenous combination of the particles and granules and will avoid particle segregation during processing, packaging and shipping. Generally, detergent granules are about 100–1000 microns (average diameter) in size. Suitable water-insoluble inert filler materials include methyl cellulose, malto dextrin, and gelatin. The particles may be coated or agglomerated utilizing a Wurster fluid bed coater by first making an aqueous solution of the agglomerating material and then contacting the solution with the particles in the fluid bed coater.

The perfumed particles may be simply mixed into liquid detergent compositions. Examples of suitable liquid laundry detergent compositions for use in the present invention include U.S. Pat. No. 4,490,285, Kebanli, issued Dec. 25, 1984, and U.S. Pat. No. 4,507,219, Hughes, issued Mar. 26, 1985. However, the perfumed particles may first be coated with a pH-sensitive material as disclosed suDra. to further prevent premature diffusion of the perfume out of the particles.

The preferred particle may also be utilized with a laminated laundry product formed from two plies of water-insoluble tissue, at least one of which is water permeable, which are laminated together. At least one of the plies has cup-like depressions, surrounded by rims, and the other ply being attached to the first ply at the rim to physically separate the cups. Plies of the tissue paper described in U.S. Pat. No. 4,529,480, Trokhan, issued July 16, 1985, may be utilized. Other materials which can be used to form suitable laminates and processes for forming laminates are disclosed in U.S. Pat. Nos. 4,571,924, Bahrani, issued Feb. 25, 1986, and 4,638,907, Bedenk et al, issued Jan. 27, 1987. Detergent compositions suitable for use with such laminated laundry products are disclosed, for example, in U.S. Pat. No. 4,715,979, Moore et al, issued Dec. 29, 1987.

It may be desirable to also add perfume to the composition, as is, without protection via the particles. Such perfume loading would allow for aesthetically pleasing fragrance of the composition itself. Upon opening the package containing the composition and as the product is added to water, this immediate release of fragrance may be desirable.

This perfume would be added via conventional means, e.g., mixing, as is, into a liquid composition or spraying onto dry product compositions. The protected perfume in the particles provides an additional benefit, i.e., enhanced perfuming of the fabric as it leaves the laundry process.

Typically, for laundry detergent compositions an amount of the perfume particles is incorporated in the composition so as to provide the composition with from about 0.001% to about 10%, preferably from about 0.1% to about 3%, perfume.

Use of the perfume particles of the present invention in laundry detergent compositions provides an efficient means for delivery of a wide variety of perfume materials to fabric. Furthermore, such use provides a consistent odor profile across the laundry process, i.e., from product, to wash, rinse and dry cycles to fabric.

The perfume particles of the present invention may also be used in a wide variety of other types of cleaning products. For example, hard surface cleaning compositions such as those disclosed in U.S. Pat. Nos. 4,005,027, Hartman, issued Jan. 25, 1977; 3,985,668, Hartman, issued Oct. 12, 1976; 4,414,128, Goffinet, issued Nov. 8, 1983; and 3,679,608, Aubert et al, issued July 25, 1972, incorporated by reference herein, may be utilized with the present perfume particles and are intended to be within the scope of the present invention.

Shampoo compositions may also be utilized with the perfume particles of the present invention. Such compositions are disclosed in U.S. Pat. Nos. 4,704,272, Oh et al, issued Nov. 3, 1987; 4,741,855, Grote et al, issued May 3, 1988; and 4,345,080, Bolich, Jr., issued Aug. 17, 1982 (combination shampoo and hair conditioning composition), herein incorporated by reference, and are intended to be within the scope of the present invention.

Dishwashing detergent compositions such as the light-duty liquid detergent compositions described in U.S. Pat. Nos. 4,133,779, Hellyer et al, issued Jan. 9, 1979; 4,316,824, Pancheri, issued Feb. 23, 1982; and 4,555,360, Bissett et al, issued Nov. 26, 1985, incorporated by reference herein, may also have the perfume particles of the present invention incorporated therein and are intended to be within the scope of the present invention. Granular automatic dishwashing detergent compositions may also be utilized with the present perfume particles. Examples of such compositions are disclosed in U.S. Pat. Nos. 4,714,562, Roselle et al, issued Dec. 22, 1987, and 3,630,923, Simmons et al, issued Dec. 28, 1971, incorporated by reference herein. Liquid automatic dishwashing detergent compositions such as those described in European Patent Application No. 201,496, published Apr. 27, 1988, incorporated by reference herein, are also useful in combination with the present perfume particles.

Bar soap compositions may also be utilized with the perfume particles of the present invention. Such compositions are described in U.S. Pat. Nos. 4,557,853, Collins, issued Dec. 10, 1985; 4,673,525, Small et al, issued June 16, 1987; and 4,714,563, Kajs et al, issued Dec. 22, 1987, all of which are incorporated by reference herein, and are intended to be within the scope of the present invention.

Laundry bleach compositions may also be used with the perfume particles of the present invention, since the perfume is protected from the bleach by the carrier materials. Examples of such compositions are disclosed in U.S. Pat. No. 4,412,934, Chung et al, issued Nov. 1, 1983 (dry granular); British Patent No. 2,188,654, published Oct. 7, 1987; and U.S. Pat. No. 4,100,095, Hutchins, issued July 11, 1978 (liquid), all of which are incorporated by reference herein.

CONDITIONING COMPOSITIONS

The perfume-containing particles of the present invention may also be incorporated into fabric conditioning compositions. Such compositions typically contain as active ingredients cationic softeners. The cationic softeners useful in the present fabric softening compositions can be any of those substantially water-insoluble cationic active materials generally recognized in the art for their fabric softening properties. Typical examples are:

(a) Mono nitrogen quaternary ammonium cationic salts having the structure:

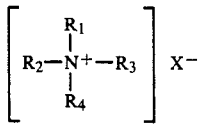

wherein $R_1$ is selected from $C_1$ to $C_{20}$ alkyl and alkenyl groups and $R_2$ is selected from the group consisting of $C_{14}$ to $C_{20}$ alkyl and alkenyl groups and $R_3$ and $R_4$ are the same or different from each other and are selected from the group consisting of $C_1$ to $C_3$ alkyls or $-(C_nH_{2n}O)_xH$ wherein n is 2 or 3, x is from 1 to about 3, and wherein $X^-$ is halide, $HSO_4-$, nitrate, methylsulfate or ethylsulfate. It is preferred that $X^-$ be halide, and the preferred halides are chloride and bromide. Exemplary compounds of this class are: stearyltrimethyl ammonium chloride, myristyltriethyl ammonium bromide, dimyristyldimethyl ammonium chloride, dipalmityldiethyl ammonium bromide, distearyldimethyl ammonium chloride, distearyldimethyl ammonium bromide, distearyldiisopropyl ammonium bromide, diarachidyldimethyl ammonium chloride, distearyl-2-hydroxypropylmethyl ammonium chloride, oleylstearyldimethyl ammonium ethylsulfate, distearyl-2-hydroxyethylmethyl ammonium methylsulfate, and dimethyl bis(stearoyl oxyethyl) ammonium chloride, dimethyl alkyl ether ester ammonium quarternary compounds, and dimethyl diisopropyl ester ammonium quarternary compounds. Preferably the $R_1$ and $R_2$ groups are derived from tallow and the $R_3$ and $R_4$ groups are methyl. The tallow can be hydrogenated or unhydrogenated. Hydrogenated (i.e., saturated) tallow is preferred, and halides are the preferred anions. Accordingly, preferred mono nitrogen quarternary ammonium salt softener compounds herein are dihydrogenatedtallow dimethyl ammonium chloride and dihydrogenatedtallow dimethyl ammonium bromide.

(b) Imidazolinium salts of the formula:

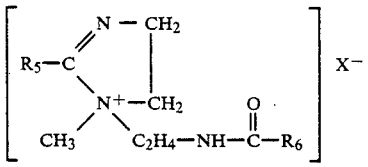

wherein $R_5$ and $R_6$ are the same or different from each other and are selected from the group consisting of $C_{14}$ to $C_{20}$ alkyl and alkenyl groups, wherein $X^-$ is as defined above.

Exemplary compounds of this type are: 1-methyl-1-tallowamidoethyl-2-tallowimidazolinium methylsulfate, 1-methyl-1-oleylamidoethyl-2-oleylimidazolinium chloride, 1-methyl-1-palmitoleylamidoethyl-2-palmitoleylimidazolinium ethylsulfate, 1-methyl-1 soyaamidoethyl-2-soyaimidazolinium methylsulfate, 1-methyl-1-hydrogenatedtallowimidazolinium methyl sulfate, and 1(2-tallowylaminoethyl)-2 tallowylimidazoline.

(c) Di(2-amidoethyl)methyl quaternary ammonium salts having the structure:

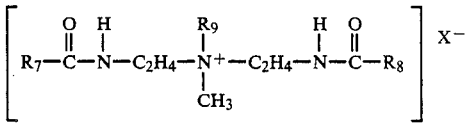

wherein $R_7$ and $R_8$ are the same or different from each other and are selected from the group consisting of $C_{14}$ to $C_{20}$ alkyl and alkenyl groups, wherein $R_9$ is selected from H, methyl, ethyl and $-(C_nH_{2n}O)_xH$ wherein n is 2 or 3 and x is from 1 to about 5 (preferably 3), and wherein $X^-$ is as defined above. Preferably $R_7$ and $R_8$ are alkyl and $R_9$ is $-(C_nH_{2n}O)_xH$. This class of compounds is disclosed in U.S. Pat. No. 4,134,840, Minegishi et al, issued Jan. 16, 1979, incorporated herein by reference.

Exemplary compounds are di(di-hydrogenatedtallowamidoethyl) ethoxylated (2 ethoxy groups) methyl ammonium methylsulfate, di(2-hydrogenatedtallowamidoethyl) dimethyl ammonium ethylsulfate, di(2-palmitylamidoethyl)-2-hydroxyethyl ammonium chloride, di(2-oleylamidoethyl) propoxylated (3 propoxy groups) methyl ammonium bromide, di(2-palmitoleylamidoethyl) dimethyl ammonium ethylsulfate and di(2-stearylamidoethyl) propoxylated (2 propoxy groups) methyl ammonium methylsulfate.

The cationic softener compounds are present in the compositions of the invention at levels of from about 1% to about 50%, preferably from about 3% to about 35%. The softeners can be used singly or in mixtures.

Amines may be present in the compositions herein, either as a minor component sometimes present in the cationic softeners which are used, or are purposely added to the compositions to impart some desired property, e.g., for improved emulsification of the cationic softeners, for freeze-thaw recovery (i.e., recovery of the compositions to a homogeneous condition after being frozen), for viscosity control or as supplementary softeners.

Generally, the amount of amine present in the compositions herein will be from about 0.05% to about 5%, more typically from about 0.1% to about 2%.

Typical amine components found in cationic fabric softener compositions are dihydrogenatedtallow methyl amine, 1-tallowamidoethyl-2-tallowimidazoline and di(2-hydrogenatedtallowamidoethyl)alkyl ethoxylated amine.

Useful amines for freeze-thaw recovery, emulsification and viscosity control are compounds of the formula:

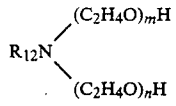

wherein $R_{12}$ is an alkyl or alkenyl group of from about 14 to about 20 carbon atoms and m +n is from about 2 to about 30. A typical commercial material of this class is sold under the name Varonic T-220D by Sherex Chemical Company.

Diamines are also useful emulsifying and freeze-thaw recovery agents in the compositions herein. (See U.S. Patent No. 4,045,361, Watt et al, issued Aug. 30, 1977, and EPO Application 18039, Clint et al, published Oct. 29, 1980, both incorporated by reference herein.) A typical exemplary diamine is N-talloyl-N,N',N'-tris(2-hydroxyethyl)-1,3-propane-diamine.

Typical monoamines which can be used as supplementary softeners include stearyldimethyl amine, dihydrogenatedtallowmethyl amine and hydrogenatedtallowdimethyl amine.

Materials which are typically used in fabric softener compositions can be optionally used in the compositions of the present invention. These include lower alcohols (e.g., ethanol, isopropanol, etc.), perfumes, dyes, ionizable salts for viscosity control, nonionic fabric softeners (e.g., long-chain hydrocarbons and fatty glycerides), fatty acids, and polyethylene glycols.

Other ingredients employable in fabric softening compositions can also be included, for example, ironing aids such as silicones or dextrin derivatives, preservatives and bactericides, whether effective to protect the composition or to treat fabrics, soil release polymers (as described above), and the like.

Examples of suitable liquid fabric softening compositions for use in the present invention are those disclosed in U.S. Pat. No. 3,974,076, Wiersama et al, issued Aug. 10, 1976; U.S. Pat. No. 4,424,134, Sissin et al, issued Jan. 3, 1984; and U.S. Pat. No. 4,661,269, Trinh et al, issued Apr. 28, 1987.

Additional fabric softening articles useful in the present invention are those in the form of a fabric softening composition adhered to an absorbent substrate, such as paper or a woven or non-woven cloth sheet, are disclosed in U.S. Pat. No. 4,073,996, Bedenk et al, issued Feb. 14, 1978; U.S. Pat. No. 3,944,694, McQueary, issued Mar. 16, 1976; and U.S. Pat. No. 4,237,155, Kardouche, issued Dec. 2, 1980.

It may be desirable to also add perfume to the conditioning composition, as is, without protection via the particles. Such perfume loading would allow for aesthetically pleasing fragrance of the composition itself. Upon opening the package containing the composition and as the product is added to water, this immediate odor impact is desirable.

This perfume would be added via conventional means, e.g., mixing, as is, into a liquid composition or spraying onto dry product compositions. The protected perfume in the particles provides a different benefit, i.e., perfuming the clothes as they leave the laundry process.

Typically, for conditioning detergent compositions an amount of the perfume particles is incorporated in the composition so as to provide the composition with from about 0.001% to about 10%, preferably from about 0.1% to about 3%, perfume.

Use of the perfume particles of the present invention in fabric softening compositions provides an efficient means for delivery of a wide variety of perfume materials to fabric. Furthermore, such use provides a consistent odor profile from product, through the laundry process, to fabric.

The perfumed particles of the present invention may also be used in hair conditioning compositions and conditioning shampoo compositions such as those disclosed in U.S. Pat. No. 4,764,363, Bolich, issued Aug. 16, 1988, and European Patent Publications 205,306, published Dec. 17, 1986 and 240,350, published Oct. 7, 1987. Such compositions are intended to be within the scope of the present invention.

METHOD OF USE

During the washing or conditioning process, the perfume particles are delivered to the surface to be perfumed. Thereafter the perfume will diffuse out of the particles and give the surface the desired fragrance impart.

In the laundry process, the perfume particles adhere to the fabric being laundered as they contact it. When the laundered fabrics are transferred to a clothes dryer or line dried the perfume is believed to diffuse out of the particles in a substantially unaltered state, thus delivering an enhanced perfume to the fabric.

The following examples illustrate the present invention. It will be appreciated that other modifications of the present invention, within the skill of those in the laundry composition formulation art, can be undertaken without departing from the spirit and scope of this invention.

All parts, percentages, and ratios herein are by weight unless otherwise specified.

EXAMPLE I

The perfume particles useful in laundry compositions of the present invention are prepared as follows:

Twenty-five grams of POLYWAX 2000 (polyethylene having a molecular weight of 2000) is heated in a beaker on a hot plate at about 130° C. just until melted. 8.33 Grams of perfume at room temperature is added to the melted POLYWAX and the mixture remains in the fluid state.

An Osterizer Blender with a custom made stainless steel cylindrical vessel which is about 7 cm in diameter, about 10 cm in height, about 0.5 cm thick, and completely enclosed except for a pinhole in the top to allow for release of nitrogen is used to grind the solid POLYWAX perfume into particles. The blender container is first chilled with liquid nitrogen. The melted POLYWAX/perfume is quickly mixed and then poured into the blender container, and more liquid nitrogen is added to quickly chill/harden the POLYWAX/perfume mixture.

The blender is set on its highest speed, and the solid POLYWAX/perfume is ground for 30 seconds. The top and sides of the blender container are tapped to knock the particles back down to the bottom of the blender container, and the solid POLYWAX/perfume is ground again at high speed for 30 seconds.

The particles may be washed with methanol to clean from the particle surfaces unincorporated perfume which may make the particle surfaces too sticky. About 100 ml of methanol per 40 grams of particles is generally sufficient. Suction filtration is used to remove excess methanol from the particles, and the particles preferably are permitted to additionally stand in open air to allow any remaining methanol to evaporate.

The particles may be sieved to obtain particles in the most desirable size range. Sieves having 250 and 125 micron openings may be used to obtain particles primarily in the 125 to 250 micron size range.

Particles thus sieved are about 80% in the 125 to 250 micron size range. These particles may be added to conventional laundry products to provide the compositions with a level of perfume of from about 0.1% to about 3.0%. The particles allow for protection of the entrapped perfume through the laundry process. The particles adhere to the laundered textiles and are carried into the dryer. As textiles are dried in a heat elevated environment, the perfume diffuses out of the particles. This released perfume is essentially unaltered from its original state.

If a particularly volatile perfume is used to make the perfume particles, the perfume may be mixed with silica gel prior to mixing with the melted POLYWAX 2000. The ratio of perfume to silica gel may be about 80:20. After the perfume and silica gel are combined, it is most desirable to allow the combination to stand (covered) for several hours before combining with the melted POLYWAX. The perfume/silica gel is desirably mixed with the melted POLYWAX 2000 at a ratio of about 1:2.3.

EXAMPLE II

Perfume particles that provide additional protection for use in liquid compositions are prepared as follows. The particles of Example I are coated with an amount of the acrylic resin EUDRAGIT (available from Rohm Pharma) sufficient to comprise 12%, by weight, of the particles. The coating process is accomplished utilizing a Wurster fluid bed coater by first making an aqueous solution of the coating material and then contacting the solution with the particles in the fluid bed coater for a time sufficient to deposit the desired amount of coating material to the particles. The plasticizer substance diethyl phthlate may be combined with the pH-sensitive coating material prior to the coating process to provide a more durable coating to the particles. The plasticizer is added in an amount sufficient to comprise 1%, by weight of the particles.

These coated perfume particles will provide additional protection against diffusion of perfume out of the particles through extended storage periods in the liquid composition. When the particles are introduced into an environment having a different pH, the coating may be stripped away and the perfume will diffuse out of the particles and provide the fragrance benefit.

EXAMPLE III

The following is a bleach-containing granular laundry detergent composition:

| Component | Weight % |
|---|---|
| Sodium $C_{13}$ alkylbenzene sulfonate | 7.5 |
| Sodium $C_{14-15}$ alkylsulfate | 7.5 |
| $C_{12-13}$ alkyl polyethoxylate (6.5) stripped of unethoxylated alcohol and lower ethoxylate | 2.0 |
| $C_{12}$ alkyltrimethyl ammonium chloride | 1.0 |
| Sodium tripolyphosphate | 32.0 |
| Sodium carbonate | 10.0 |
| Sodium perborate monohydrate | 5.3 |
| Sodium octanoyloxybenzene sulfonate | 5.8 |
| Sodium diethylene triamine pentaacetate | 0.5 |
| Sodium sulfate, $H_2O$ and minors | Balance |

The above composition is prepared using conventional means. The composition is combined with the perfume particles of Example I as follows. An amount of the perfume particles of Example I is combined with the detergent composition so that the detergent composition comprises about 0.3% perfume (about 1½% of the detergent composition will comprise the perfume particles).

The particles may be simply mixed in with the detergent granules. To prevent segregation of the perfume particles during packaging and shipping (due to their smaller size relative to the detergent granules), the particles may be coated or agglomerated with a water-soluble coating material prior to combining with the detergent granules. This can be accomplished with a Schugi mixer (Flexomix 160) where a sufficient amount of a dextrin glue solution (2% dextrin, 3% water) is sprayed onto the particles to result in agglomerates of perfume particles in the same size range as other detergent granules.

The perfume is protected in the particles from degradation by the bleach in the detergent composition over long periods of storage. When used in the laundry process this detergent composition will provide perfume fragrance in substantially its original state from product, through the wash process to fabric.

A great number of perfumes can be utilized in the present composition that would not otherwise be appropriate for use in such laundry detergent compositions.

EXAMPLE IV

Granular laundry detergent compositions of the present invention are prepared as follows:

| | Weight % | | | | |
|---|---|---|---|---|---|
| Component | A | B | C | D | E |
| $C_{12}$ alkylbenzene sulfonate (sodium) | 6.8 | 7.0 | 10.0 | 5.6 | 5.9 |
| Tallow alcohol sulfate (sodium) | — | — | 3.0 | 2.4 | 2.5 |
| Tallow alcohol polyethoxylate(E011) | 0.9 | 0.9 | 1.0 | 0.4 | 0.3 |
| Fatty alcohol ($C_{12-15}$) polyethoxylate(7) | — | — | 2.0 | 5.8 | 5.0 |
| Cetyl dimethyl amineoxide | 0.4 | 0.5 | — | — | — |
| Hydrogenated fatty acid | 0.2 | 0.3 | 1.0 | — | — |
| Sodium tripolyphosphate | 22.0 | — | 24.0 | 24.0 | — |
| Zeolite 4A | — | 21.0 | — | 5.4 | 20.5 |
| Sodium nitrilotriacetate | — | 3.0 | 4.0 | — | — |
| Sodium carbonate | 10.0 | 7.0 | — | 13.5 | 12.8 |
| Sodium perborate (1 aq.) | 2.0 | — | — | 14.0 | 2.0 |
| Sodium perborate (4 aq.) | 11.0 | 15.0 | — | — | 13.0 |
| TAED | 1.0 | 1.2 | — | 5.3 | 2.1 |
| $C_{12}$ alkyl trimethyl ammonium chloride | 1.5 | 1.9 | — | — | — |
| Distearyl methylamine | 2.5 | 3.1 | — | — | — |
| Sodium silicate ($SiO_2/Na_2O$ = 1.6) | 7.1 | 3.0 | 8.0 | 7.7 | 2.9 |
| Carboxymethylcellulose | 0.3 | 0.4 | 0.8 | — | 0.3 |
| Copolymer maleic/acrylic acid (70/30 MW 40000-80000) | 2.0 | 1.0 | 1.0 | 2.6 | — |
| Na-polyacrylate (MF 1000-10000) | — | 2.0 | 1.0 | 1.0 | 3.9 |
| Sulfonated zinc phthalocyanine | 30 ppm | — | 25 ppm | 40 ppm | — |
| EDTA | 0.2 | 0.2 | 0.4 | 0.5 | 0.3 |
| Ethylenediamine tetramethylene phosphonic acid (Na salt) | 0.1 | 0.3 | 0.1 | 0.2 | 0.3 |
| Enzymes (protease, amylase, cellulase, lipase) | 0.4 | 0.8 | 0.6 | 1.6 | 0.8 |
| Optical brightener | 0.2 | 0.2 | 0.3 | 0.2 | 0.2 |
| Silicone/silica suds suppressor | 0.7 | 0.5 | 0.6 | 0.5 | 0.4 |
| Smectite clay | 8.0 | 6.5 | — | — | — |
| Sulfate, minors, water | Balance to 100% | | | | |

The above compositions are prepared using conventional means. The composition is combined with the perfume particles of Example I as follows. An amount of the perfume particles is added to the above compositions so that about 2% of the composition comprises the perfume particles. The particles are simply mixed into the detergent composition, or they may be coated or agglomerated to achieve somewhat larger particle size to prevent segregation of the particles out of the composition during shipping, etc.

The perfume is protected in the particles from degradation or dissipation over long periods of storage. When used in the laundry process, this detergent composition will provide perfume fragrance in substantially its original state from product, through the wash process to fabric.

EXAMPLE V

A laundry detergent and conditioning composition is prepared as follows:

| Component | Weight % |
|---|---|
| Dimethyl di-hydrogenated tallow ammonium chloride (95% active powder) | 75 |
| Tallow alcohol | 25 |
| | 100 |

The dimethyl di-hydrogenated tallow ammonium chloride (DTDMAC) and tallow alcohol are melted together to form a clear solution at 250° F. This molten solution is atomized at 1600 psi into a chamber with ambient temperature air passing through the chamber. The atomized droplets freeze into solid particles in the size range of about 20 microns to about 150 microns. The softening point of the DTDMAC/tallow alcohol mixture is about 165° F. The DTDMAC/tallow alcohol mixture has a solubility of substantially less than 10 ppm in 25° C. water.

Sodium tripolyphosphate (STP) is then mixed with the DTDMAC/tallow alcohol prills in a 4:7 ratio of polyphosphate:prill. The sodium tripolyphosphate is a dry, anhydrous powder with at least 90% passing through a 100-mesh Tyler sieve. The 7:4 ratio DTDMAC/tallow alcohol prill:sodium tripolyphosphate (STP) mixture is fed into a Schugi mixer (Flexomix 160) where about 5 parts dextrin glue solution (1.67 parts dextrin, 3.33 parts water) is sprayed onto the mixture. This results in agglomerates of prill-STP in the same size range as other detergent granules, about 150 to 1190 microns.

The 16 parts prill-STP agglomerates are then discharged from the Schugi Flexomix 160 mixer and mixed with about 12 parts of sodium montmorillonite clay of good fabric softening performance and having an ion exchange capacity of about 63 meq/100 g (available from Georgia Kaolin Co. U.S.A. under the trade name Brock). The resulting mix is aged for approximately one hour and then mixed with 0.4 parts of silica to increase flowability. The total admix comprises 7 parts DTDMAC/tallow alcohol prill, 4 parts STP, 5 parts dextrin glue solution, 12 parts sodium montmorillonite clay and 0.4 parts silica, resulting in a 28.4 part admix to detergent granules. The particulate detergent additive is incorporated into a detergent composition as follows:

| Component | Weight % |
|---|---|
| Sodium $C_{11.8}$ alkylbenzene sulfonate | 7.70 |
| Sodium tallow alkyl sulfate | 4.23 |
| Sodium $C_{14-16}$ alkyl triethoxy sulfate | 4.23 |
| Sodium tripolyphosphate | 19.25 |
| Sodium silicate (2.0 ratio) | 11.55 |
| Sodium sulfate | 19.25 |
| Water | 3.85 |
| Miscellaneous (perfume, brightener, etc.) | 1.54 |
| Subtotal Weight % | 71.6% |
| Plus the particulate detergent admix: | |
| Sodium montmorillonite | 12.0% |
| Silica | 0.4% |
| AGGLOMERATE | |
| Sodium tripolyphosphate | 4.0% |
| DTDMAC/tallow alcohol prill | 7.0% |

-continued

| Component | Weight % |
|---|---|
| Dextrin glue solution | 5.0% |
| Subtotal Weight % | 28.4% |
| TOTAL Weight % | 100.0% |

The above composition is combined with the perfume-containing particles of Example I as follows. An amount of the perfume particles of Example I is combined with the combination detergent and conditioning composition so that the composition comprises about 0.6% perfume (about 2½% of the detergent composition will comprise the perfume particles). The particles may be simply mixed into the detergent and conditioning granules or may be agglomerated with a water-soluble material to provide agglomerates of perfume in the same size range as the detergent and conditioning granules, as described in Example III.

EXAMPLE VI

Liquid detergent compositions of the present invention are as follows:

| Component | Weight % A | Weight % B |
|---|---|---|
| $C_{13}$ linear alkylbenzene sulfonic acid | 7.2 | 7.2 |
| $C_{14-15}$ alkyl polyethoxylate (2.25) sulfuric acid | 10.8 | 10.8 |
| $C_{12-13}$ alcohol polyethoxylate (6.5)* | 6.5 | 6.5 |
| $C_{12}$ alkyl trimethylammonium chloride | 1.2 | 0.6 |
| $C_{12-14}$ fatty acid | 13.0 | — |
| Oleic acid | 2.0 | — |
| Palm kernel fatty acid (stripped) | — | 15.0 |
| Citric acid (anhydrous) | 4.0 | 4.0 |
| Diethylenetriamine pentaacetic acid | 0.23 | 0.23 |
| Protease enzyme (2.0 AU/g) | 0.75 | 0.75 |
| Amylase enzyme (375 Am. U/g) | 0.16 | 0.16 |
| TEPA-$E_{15-18}$** | 1.5 | 1.5 |
| Monoethanolamine | 2.0 | — |
| (moles of alkanolamine) | (0.033) | (0) |
| Sodium ion | 1.66 | 2.75 |
| Potassium ion | 2.65 | 2.55 |
| (molar K+:Na+) | (0.94) | (0.55) |
| Propylene glycol | 6.8 | 5.0 |
| Ethanol | 7.8 | 8.5 |
| Formic acid | 0.66 | 0.66 |
| Calcium ion | 0.03 | 0.03 |
| Minors and water | Balance to 100 | |
| pH at concentration of 10% in water at 68° F. (20° C.) | 8.65 | 8.5 |

*Alcohol and monoethoxylated alcohol removed

**Tetraethylene pentaimine ethoxylated with 15–18 moles (avg.) of ethylene oxide at each hydrogen site Composition A is prepared by adding the components, with continuous mixing, in the following order: paste premix of alkylbenzene sulfonic acid, sodium hydroxide, propylene glycol and ethanol; paste premix of alkyl polyethoxylate sulfuric acid, sodium hydroxide and ethanol; pentaacetic acid; alcohol polyethoxylate; premix of water, brighteners, alkanolamine and alcohol polyethoxylate; ethanol; sodium and potassium hydroxide; fatty acid; citric acid; formic acid and calcium; alkyl trimethylammonium chloride; TEPA-$E_{15-18}$; adjust pH to about 8.1; and balance of components.

Composition B is prepared by adding the components, with continuous mixing, in the following order: paste premix of alkyl polyethoxylate sulfuric acid and ethanol; 2.5 parts water; propylene glycol; premix of ethanol and brightener; ethanol; premix of water, propylene glycol and brightener; alcohol polyethoxylate;

sodium hydroxide; potassium hydroxide; fatty acid; alkylbenzene sulfuric acid; premix of citric acid and calcium; pentaacetic acid; formic acid; alkyl trimethylammonium chloride; TEPA-$E_{15-18}$; potassium hydroxide and water; and balance of components.

Compositions A and B are isotropic liquids as made and remain isotropic down to about 50° F. (10 ° C.). They also recover to an isotropic form, after freezing and thawing, by about 55° F. (12.8° C.).

The above composition is combined with the perfume-containing particles of Example I as follows. An amount of the perfume particles of Example I is thoroughly mixed into the liquid detergent composition so that the detergent composition comprises about 0.3% perfume (about 1% of the detergent composition will comprise the perfume particles).

EXAMPLE VII

An aqueous fabric softening composition containing as fabric softening active a 39.2:60.8 mixture of mono(-hydrogenated tallow)trimethylammonium chloride and the reaction product of 2 moles of fatty acids with 1 mole of N-2-hydroxyethylethylenediamine is prepared as follows: 4.41 parts of reaction product of hydrogenated tallow fatty acids with N-2-hydroxyethylethylenediamine (Mazamide 6) are weighed into a premix vessel, followed by 5.68 parts of commercial mono(hydrogenated tallow)trimethylammonium chloride (Adogen 441, 50% active in 50% isopropanol). This premix is melted, mixed and heated to 77° C. The premix is then added, with agitation, to a mix vessel containing 89.87 parts of distilled water heated to 66° C., followed by 0.02 part of a commercial mixture of 5-chloro-2-methyl-4-isothiazolin-3-one and 2-methyl-4-isothiazolin-3-one (Kathon CG/ICP, 1.5% active, room temperature). The mixture is cooled to 49° C. with continued agitation, and 0.02 part of a $CaCl_2$ solution (25% aqueous solution, room temperature) is added. At this stage the pH of the mixture is about 9.4. The pH is adjusted to 6.0 by the addition of a small amount of concentrated sulfuric acid.

The above composition is combined with the perfume-containing particles of Example I as follows. An amount of the perfume particles of Example I is combined with the fabric softening composition so that the composition comprises about 0.4% perfume (about 1½% of the fabric softening composition will comprise the perfume particles).

EXAMPLE VIII

A liquid fabric softening composition may be prepared as follows:

| Component | % By Weight of Composition |
|---|---|
| 1(2-Tallowyl Amidoethyl)-2 Tallowyl-Imidazoline | 4.85 |
| DTDMAC | 2.60 |
| Silicone Oil (350 cst) | 0.15 |
| Hydrochloric Acid | 0.30 |
| Polyethylene Glycol | 0.30 |
| Bactericide | 100 ppm |
| Water, Dye | Balance |

The above composition is prepared using conventional means. The composition is combined with the perfume particles of Example II as follows. An amount of the perfume particles of Example II is combined with the fabric softening composition so that the composition comprises about 0.45% perfume (about 2% of the fabric softening composition will comprise the perfume particles).

The coated perfume particles provide enhanced protection against diffusion out of the perfume during product storage. When the composition is added to the laundry wash water (having a higher pH than the fabric softening composition), the coating material may be stripped away and the perfume is free to diffuse out of the particles more readily thereafter.

Another fabric softening composition may be made as above except that the levels of active components (i.e., everything but water and dye) are present at three times the levels quoted above. Yet another fabric softening composition may be made with the levels of active components being four times those quoted above.

EXAMPLE IX

A shampoo composition for the hair is prepared as follows:

| Component | Weight % |
|---|---|
| Ammonium lauryl sulfate | 12.0 |
| Ammonium laureth (3) sulfate | 4.0 |
| Cetearyl alcohol | 0.1 |
| Glycol distearate | 1.5 |
| Cocamide MEA | 1.0 |
| Xanthan Gum | 0.3 |
| Dimethicone fluid viscosity 350 centistokes | 1.8 |
| Silicone gum (General Electric SE-76) | 1.2 |
| Lauryl trimethyl ammonium chloride | 0.75 |
| Color, preservative, pH control and water | q.s. 100% |

The composition is made by preparing both a main mix and a premix. Into the main mix tank are put the ammonium lauryl sulfate and a part of the ammonium laureth sulfate. This mixture is heated to 120°±10° F. with xanthan gum added next through a high shear pump. The total mixture is then heated to 155°±5° F. Finally the glycol distearate, amide, part of the cetearyl alcohol and lauryl trimethyl ammonium chloride are added, followed by the color, perfume, preservative and part of the water.

The premix is prepared by adding the remainder of the ammonium laureth sulfate to the premix tank and heating to 155°±5° F. The remainder of the cetearyl alcohol is then added and allowed to melt. Finally the dimethicone is added and mixed until an emulsion is formed.

The premix is mixed with the main mix through a static mixer, a higher shear mixer and finally through a heat exchanger. The total product is cooled to 80° F. and collected.

The above composition is combined with the perfume-containing particles of Example II as follows. An amount of the perfume particles of Example II is combined with the shampoo composition so that the composition comprises about 0.2% perfume (about 1% of the shampoo composition will comprise the perfume particles).

Utilization of the perfume particles in the shampoo composition provides perfume fragrance in substantially its original state from product, through the hair washing process, to the hair.

EXAMPLE X

A hair conditioning composition is prepared as follows:

| Component | Weight % |
|---|---|
| C.S. 1213 silicone fluid[1] | 0.83 |
| Cetyl alcohol | 1.00 |
| Stearyl alcohol | 0.72 |
| Adogen 442-100P[2] | 0.85 |
| Luviskol VA64[3] | 0.25 |
| Ceteareth-20[4] | 0.35 |
| Glycerol monostearate | 0.25 |
| Lexamine S-13[5] | 0.50 |
| Dow Corning 190 silicone surfactant[6] | 0.20 |
| Hydroxyethyl cellulose | 0.50 |
| Citric acid | 0.13 |
| Preservative | 0.03 |
| Purified water | 94.14 |

[1]Mixture of 15% (by weight of mixture) SE76 dimethicone gum and 85% SF1201 cyclomethicone, sold by General Electric (providing a level of non-volatile silicone of 0.12%, by weight of composition)
[2]Di(hydrogenated tallow) dimethyl ammonium chloride, sold by Sherex Chemical Company, Inc.
[3]Copolymer of polyvinylpyrrolidone and vinyl acetate, sold by BASF A.G.
[4]Ethoxylated cetostearyl alcohol
[5]Stearamido propyl dimethyl amine, sold by Inolex Corporation
[6]Dimethicone copolyol, sold by Dow Corning Corporation The hydroxyethyl cellulose is added to the water, maintained at a temperature of approximately 38° C. (100° F.). The PVP/VA, Adogen, Dow-190, cetyl and stearyl alcohols, ceteareth-20, Lexamine and glycerol monostearaate are then added sequentially at a temperature of approximately 87° C. (189° F.). The mixture is stirred after addition of each component for a period of time sufficient to allow proper melting of the component, i.e., the Adogen, and the dispersion into the product mixture.) The mixture is then cooled to approximately 48° C. (118° F.) at a rate of from about 1° to about 3° per minute. The citric acid, the dimethicone/-cyclomethicone mixture, and preservative are then added. The mixture is then cooled and milled under high shear for approximately 1 minute using a conventional milling apparatus.

The above composition is combined with the perfume-containing particles of Example II as follows. An amount of the perfume particles of Example II is combined with the hair conditioning composition so that the composition comprises about 0.25% perfume (about 1% of the conditioner composition will comprise the perfume particles).

Approximately 10 g of the hair conditioning product thus formed is applied to freshly shampooed and rinsed hair. The composition is then spread over the hair and allowed to stand for approximately 1 minute. Thereafter, the product is rinsed from the hair, leaving the hair with enhanced fragrance benefits.

What is claimed is:

1. A liquid laundry detergent composition, comprising:

(a) from about 10% to about 40% of a surfactant selected from the group consisting of anionic, nonionic, zwitterionic, ampholytic, cationic surfactants, and mixtures thereof;

(b) from about 5% to about 50% of a detergency builder material; and (c) perfume particles having an average size of less than about 350 microns which comprise from about 5% to about 70% of a perfume dispersed in from about 30% to about 95% of a water-insoluble polymeric carrier material having a molecular weight of from about 100 to about 30,000, a melting point of from about 37° C. to about 190° C., and a hardness value of from about 0.1 to about 15, said perfume particles comprising from about 5% to about 50% of a pH-sensitive material coating the outside surface of the particle, which pH sensitive coating remains intact in one pH environment, which occurs when the composition is diluted for use.

2. The particles of claim 1 wherein the pH-sensitive material is selected from the group consisting of acrylic resins, cellulose acetate phthalate and cellulose acetate trimellitiate.

3. The particles of claim 2 wherein the pH-sensitive material additionally comprises from about 0.5% to about 10%, by weight of the perfume particles, of a plasticizer material.

4. The particles of claim 3 wherein the plasticizer material is selected from the group consisting of diethyl phthalate, tributyl citrate, and acetyltributyl citrate.

* * * * *